United States Patent [19]

Goodley et al.

[11] 4,005,647

[45] Feb. 1, 1977

[54] STRAPPING MACHINE

[75] Inventors: George F. Goodley, Media; William H. Woomer, Glen Riddle; Udaykumar B. Inamdar, Kennett Square; Robert L. Gallagher, Aston, all of Pa.

[73] Assignee: FMC Corporation, Philadelphia, Pa.

[22] Filed: Feb. 3, 1976

[21] Appl. No.: 654,814

[52] U.S. Cl. ..... 100/4; 53/198 R; 100/7; 100/26

[51] Int. Cl.[2] ..... B65B 13/04

[58] Field of Search ..... 100/4, 26, DIG. 16, 100/7, 3, 25, 2; 53/198 R, 76

[56] References Cited

UNITED STATES PATENTS

| | | | |
|---|---|---|---|
| 3,019,577 | 2/1962 | Slamar et al. | 100/26 UX |
| 3,179,037 | 4/1965 | Cranston et al. | 100/4 |
| 3,216,346 | 11/1965 | Cruckshank et al. | 100/4 |
| 3,225,683 | 12/1965 | Rhea | 100/4 |
| 3,252,408 | 5/1966 | Winkler | 100/3 |
| 3,315,592 | 4/1967 | Lems | 100/3 |
| 3,320,874 | 5/1967 | Gasper et al. | 100/3 |
| 3,379,121 | 4/1968 | Lems | 100/2 |
| 3,417,688 | 12/1968 | Shakely | 100/26 X |
| 3,533,351 | 10/1970 | Lehmann | 100/7 |
| 3,662,678 | 5/1972 | Johnson | 100/4 |
| 3,759,169 | 9/1973 | Goodley | 100/4 X |
| 3,853,051 | 12/1974 | Tyler | 53/198 R X |

*Primary Examiner*—Billy J. Wilhite
*Attorney, Agent, or Firm*—Eugene G. Horsky; Pauline Newman; Eugene G. Seems

[57] ABSTRACT

A strapping machine for applying a tensioned strap loop horizontally about the girth of an object in which a yoke for lacing a strap about an object and means for tensioning and securing such strap are together adjustable as a unit, first into a desired projected position vertically of the object which is to be strapped, and then into a horizontal projected position in which the strap tensioning and securing means are directly adjacent to such object immediately prior to performing their respective functions.

16 Claims, 7 Drawing Figures

67
61
175
LS-4
71
77
23
LS-5
179
177
171
25
139
141
111
111
191
109
105
107
105
107
ELEC
AIR
176
169
21
17
73
75
187
178
181
LS-2
15
13
173
163
164
59
89
83
69
63
172
85
87
19
31
165
35
35

STRAPPING MACHINE

The present invention is directed to strapping apparatus and, more specifically, to an improved strapping machine for applying a tensioned strap loop horizontally about the girth of an object.

Known in the art are a variety of machines for applying straps horizontally about objects, such machines often being referred to as "horizontal strapping machines."In some instances, such machines simply position a strap about an object which is to be strapped, with manually manipulated hand tools being relied upon for the actual tensioning and fastening of such strap. Other of these machines are designed to perform repetitive strapping operations only on objects which are similar in size, and particularly objects which have generally like transverse dimensions. Still other of such known machines require precision delivery of the object into the machine and/or necessitate manipulation of the object within the machine to assure proper positioning for satisfactory strap tensioning and fastening. Accordingly, a primary object of this invention is to provide an improved and more satisfactory horizontal strapping machine.

Another object is the provision of an improved horizontal strapping machine which is adapted to apply tensioned strap loops satisfactorily about objects which are within a wide range of sizes, without necessitating manipulation of each or different of such objects to secure proper positioning of the same within the machine.

Still another object is to provide an improved horizontal strapping machine having strap applying means which may be selectively positioned vertically of an object which is to be strapped either automatically with controlled power means or manually.

A further object is to provide a horizontal strapping machine which is adapted to adjust itself to the position of the object within the machine preparatory to performance of a strapping operation.

A still further object is the provision of an improved horizontal strapping machine in which means for lacing a strap about an object which is to be strapped and means for tensioning and fastening such strap are together adjustable as a unit into different vertical and horizontal positions relative to such object.

A still further object is the provision of an improved horizontal strapping machine which is adapted to automatically perform a controlled sequence of strapping operations.

A still further object is the provision of an improved horizontal strapping machine which is flexible in use, is designed to consistently apply reliable tensioned strap loops about objects and is simple in construction and operation.

These and other objects are accomplished in accordance with the present invention by a strapping machine in which a ring extends laterally from a stationary mast in substantially a horizontal plane and is supported on such mast for movement longitudinally thereof between a retracted or home position and a projected position in which the ring encircles an object which is to be strapped. Carried by the ring are a sealing head or module and a strap yoke. The ring is supported also for traversing in its horizontal plane relative to the mast between a retracted or home position and a projected position in which the sealing head is located immediately adjacent to the object which is to be strapped.

The yoke is mounted in the horizontal plane of the ring and opens along the interior thereof. The sealing head and yoke communicate with each other so that, together, they provide a generally continuous passage for strap, with the sealing head serving, also, to secure overlapping portions of a strap loop tensioned about an object which is being strapped. Both the sealing head and yoke may be any conven- tional means which are capable of performing these functions. For example, the sealing head may be one which applies conventional metal seals or may be a friction welding means or a unit which effects strap sealing with heated air. However, admirably suited and included in the embodiment of the machine hereafter described in detail are the sealing head or module and the yoke disclosed in the United State patent 3,759,169 issued by Goodley, the teachings of which patent are incor- porated herein by reference. As fully described in the above noted Goodley patent, the sealing head includes means for feeding a strap along the yoke and into a position in which its leading end portion overlies a trailing portion thereof at the sealing head, means for gripping the leading end portion of the strap after the feeding thereof along the yoke; means for tensioning the strap about the object which is being strapped leading end portions is gripped; and means, including a retractable anvil, for heat sealing the leading end portion of the strap to an overlying trailing portion thereof.

More precisely, the ring is moved between its retracted and projected positions by a carriage which is itself mounted on the mast for movement longitudinally thereof and on which the ring is mounted for both movement with the carriage and for traversing in the horizontal plane of the ring and relative to such carriage. In its retracted or home position, the carriage is elevated on the mast well above the path of movement of an object into the machine and it is moved between such home position and a projected position, at which a strap is to be applied to an object, by a drive which is capable of either manual or power operation.

Manual movement of the carriage is facilitated merely by incorporating, in the drive, a counter-weight which essentially balances the weight of the carriage and the elements of the machine supported thereon. Power operation is achieved employing a motor in the drive. together with control means for actuating the motor and for arresting the same as the carriage enters into its retracted and projected positions. A variety means for actuating the drive motor are suitable for use in the machine of the present invention. Typical of such means for automatic machine operation, as hereafter described in detail, is a photoelectric cell which senses the presence of an object within the machine by the breaking and remaking of a photo beam from such cell. Control means for arresting motor operation when the carriage, and the ring supported thereon, are in desired projected positions for applying tensioned strap loops to an object may include, photoelectric cells, limit switches, and the like.

The ring may be traversed in its horizontal plane either manually or by a power drive. For power or automatic traversing of the ring, a pneumatic drive is preferred, with such drive simply stalling when the ring is projected against an object which is to be strapped. Such an arrangement may not be suitable for use with objects, such as a stacked array of light cartons, which are readily displaced by forceful engagement by the ring. Accordingly, in the embodiment of the invention hereafter described in detail, control means are incorporated in the machine for actuating the pneumatic drive and for arresting the same in its projected and retracted positions.

It will be noted that by traversing of the ring, within the limits of its stroke, from its home position to a projected position, at which the sealing head is located immediately adjacent to the object which is to be strapped, manipulation of the object for proper strapping position is not necessary. Thus, rather than accommodating the object to the machine by manipulating the object, the machine of the present invention accommodates itself to the object which is to be strapped.

The home position of the ring is one in which the sealing head is well removed from the location of the object and, as mentioned above, in the machine hereafter described in detail, control means are provided for actuating and arrestng the pneumatic ring traversing drive. Such control means serve, for example, to project the ring only when the carriage itself is in a desired projected position and prevent retraction of such carriage until the ring is in its home position.

As will be more apparent hereafter, the machine of this invention includes, also, various safety and operator convenience controls.

As heretofore noted, machines for applying tensioned strap loops horizontally about objects are often referred to as "horizontal strapping machines" and such designation is employed herein with reference to the machine of the present invention.

The "objects" with which the machine of this invention is adapted for use may vary in size and shape, of course within the accommodation limits of the particular machine employed, and may consist of, for example, a single package or article or a series of such packages or articles in a stacked array.

The terms "strapping" and "strap" as used herein are intended to have a common meaning and include conventional generally flat, narrow, elongated flexible structures which are capable of being fed longitudinally, and particularly, structures which are formed of synthetic thermoplastic materials, such as, polypropylene, nylon and polyesters which have been stretched or rolled to orient the molecules thereof and are capable of being thermally sealed without substantial degradation of essential physical characteristics. In the drawings FIG. 1 is a rear view of the strapping machine of the present invention;

Figure 1:
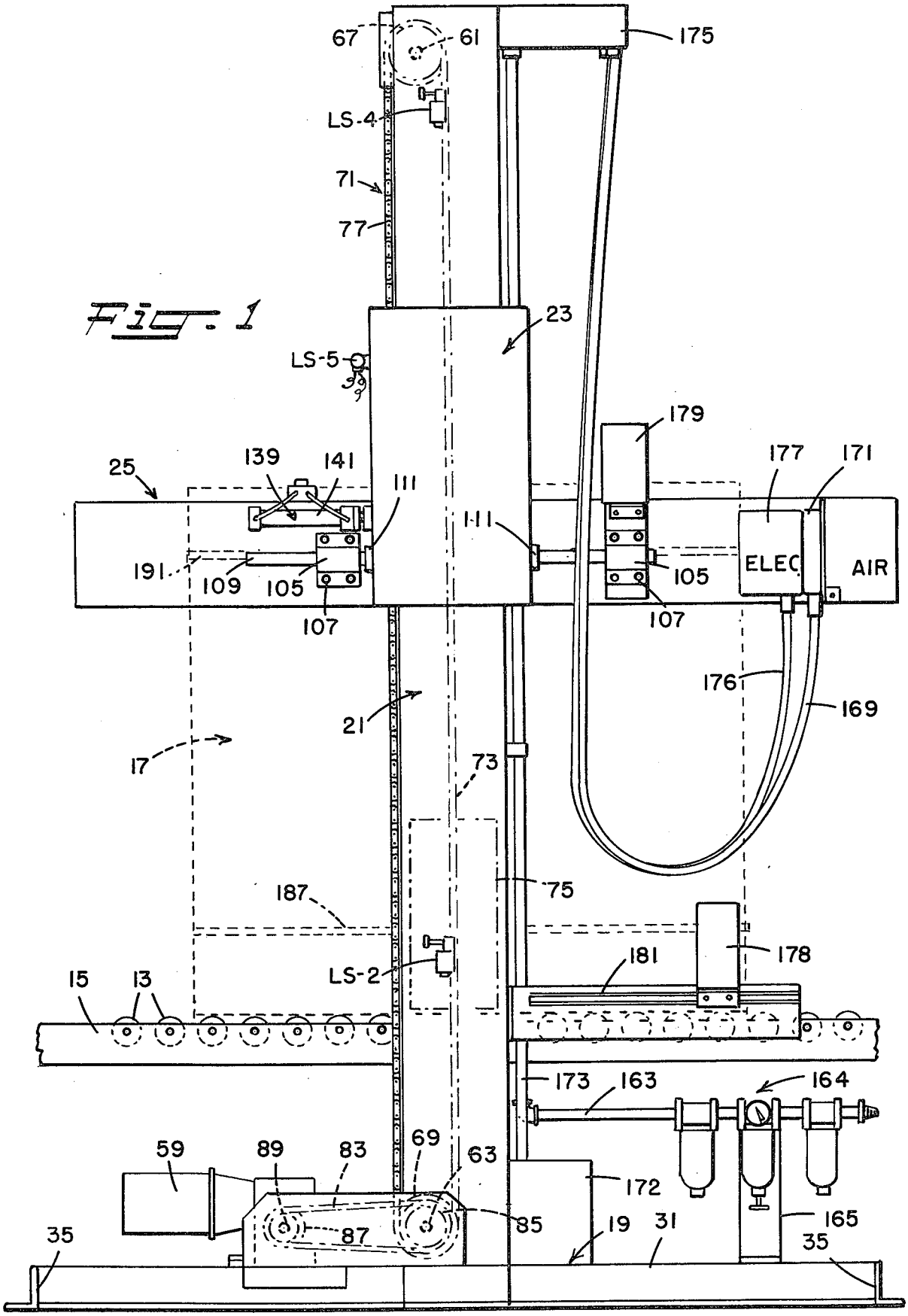

The machine of the present invention is adapted to be integrated into a production or packaging system or the like. In the embodiment illustrated on the drawings, the machine is positioned along side of a conventional roll conveyor 11, which includes idler rolls 13 and side beams 15, and which is elevated from beneath by a suitable framework, not shown. The conveyor 11 does not constitute part of the machine of the present invention and thus a powered conveyor system or any other suitable means may be employed in delivering an object 17 which is to be strapped in the machine here described.

With reference to the embodiment of the invention illustrated by the drawings, the strapping machine includes a base 19, a mast 21 fixed to and extending vertically from such base 19, a carriage 23 which is movable along the mast 21 and a ring 25 which is supported by the carriage 23 and, in turn, carries a sealing head 27 and strapping yoke 29.

The base 19 is comprised of beams 31 and 33 disposed in a common plane, with the latter being fixed substantially centrally of and at right angles to the beam 31 and extending beneath the conveyor 11. Each of the beams 31 and 33 are provided with flanges 35 by means of which the machine may be anchored in fixed position.

Figure 2:
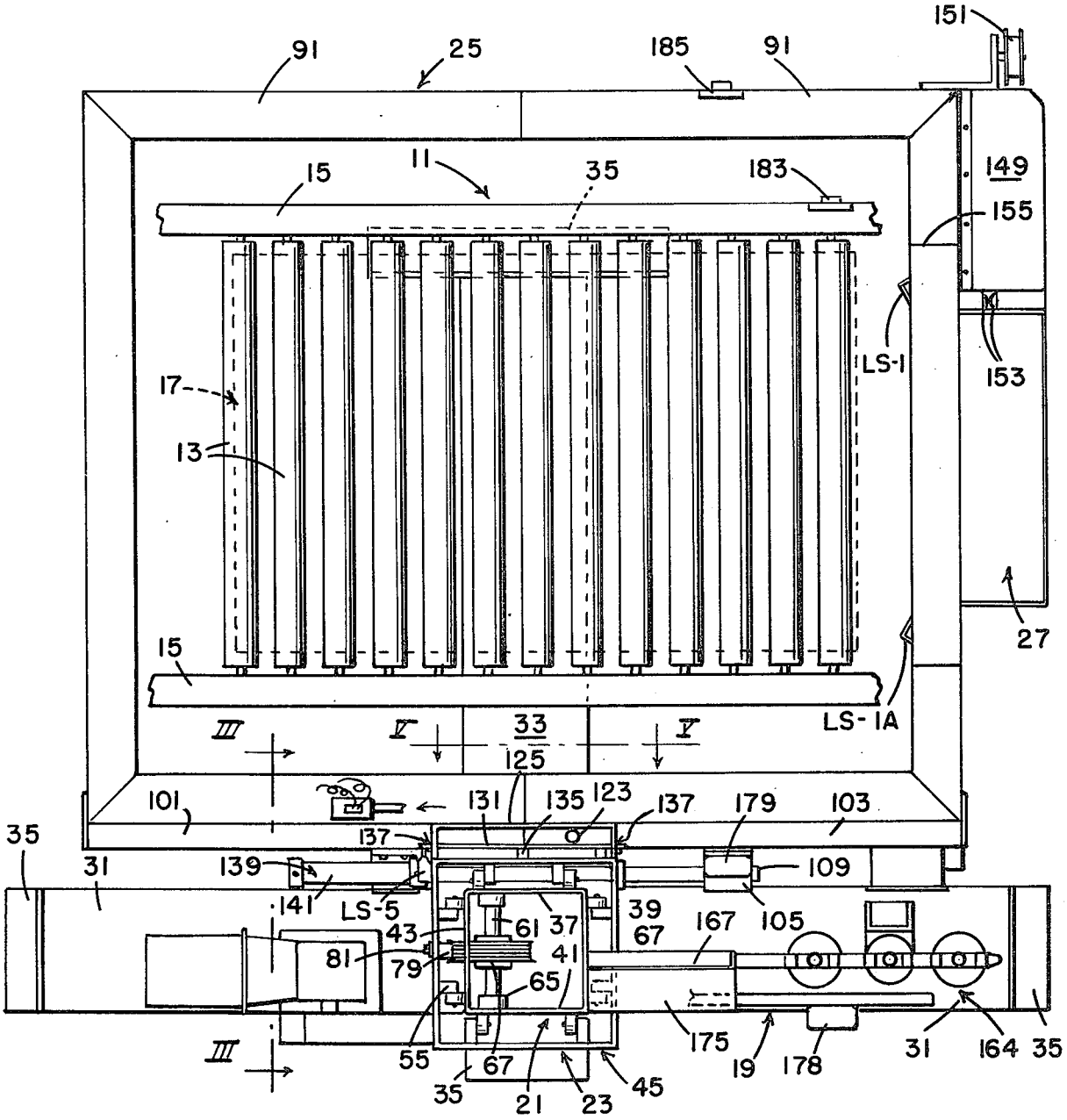
FIG. 2 is a top view of the machine illustrated in FIG. 1.
Figure 4:
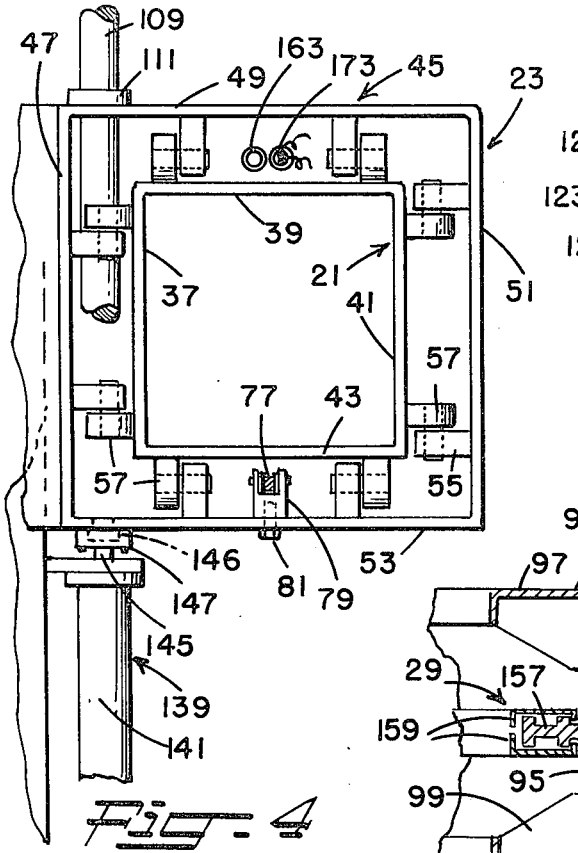
FIG. 4 is a top view of the portion of machine shown in FIG. 3 with parts thereof removed.

As shown in FIGS. 2 and 4, the mast 21 is hollow, to accommodate portions of a drive for the carriage 23, and is of square cross-section, having side walls 37, 39, 41 and 43 which permit only linear travel of the carriage 23. The carriage 23 simply consists of a rectangular sleeve 45, having walls 47, 49, 51 and 53. Lugs 55 are fixed to the inner surfaces of the walls 47, 49, 51 and 53, adjacent to opposite ends of the sleeve 45, and support rollers 57 which project beyond the respective lugs 55, and are adapted to ride along the outside surfaces of the mast walls 37, 39, 41 and 43 during travel of the carriage 23.

Figure 3:
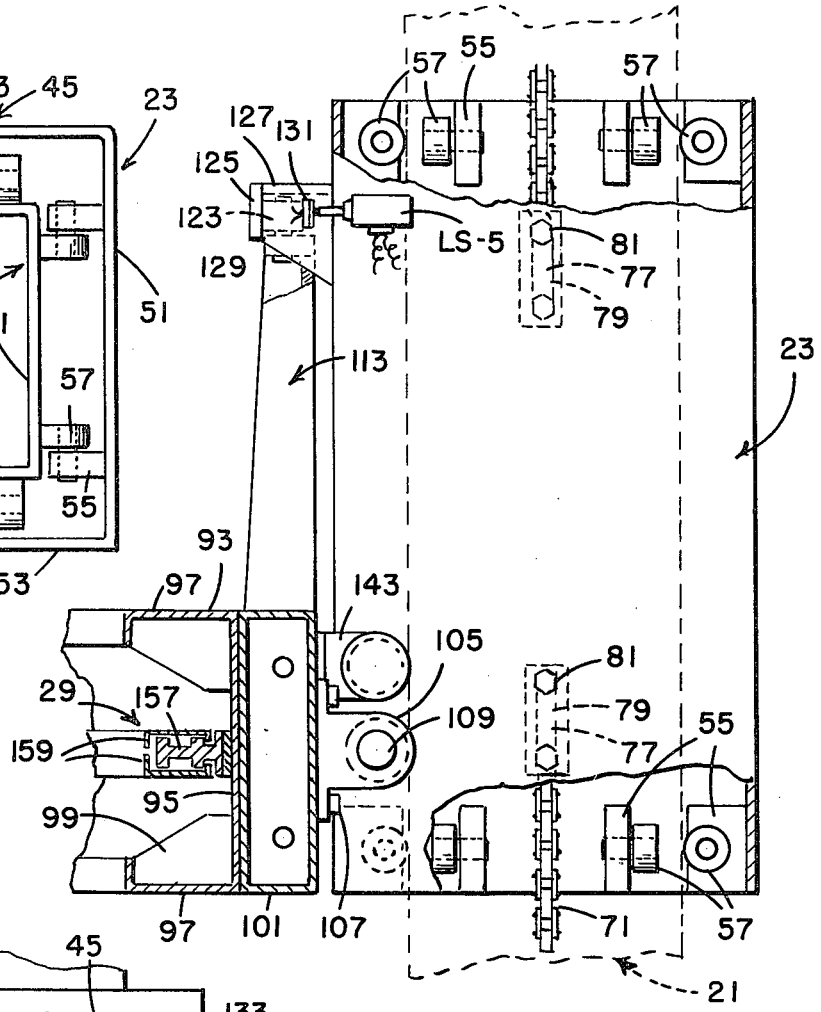
FIG. 3 is a fragmentary view of a portion of the machine shown in FIG. 2 as seen in the direction indicated by arrows III—III, with parts of the illustrated structure being broken away.
Figure 3:
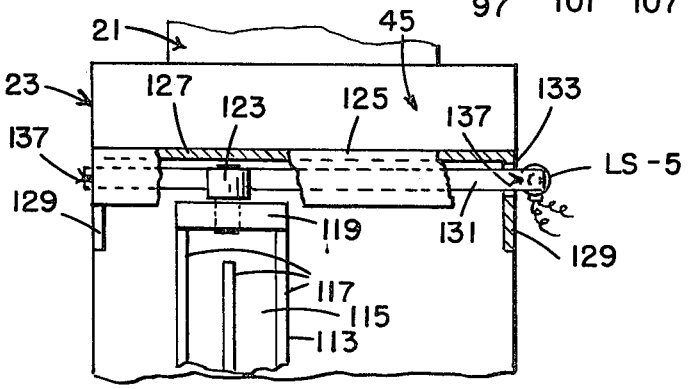

Carriage travel along the mast 21 is achieved automatically through a drive which includes an electric gear motor 59 or manually. More specifically, and as shown in FIGS. 1 and 2, the carriage drive includes shafts 61 and 63 which are rotatably mounted by bearings 65 within the mast 21 adjacent to its upper and lower ends, respectively, Sprockets 67 and 69 are fixed to the respective shafts 61 and 63 and project outwardly from the mast 21 through suitable openings formed in the mast wall 43. A chain 71 is trained over the sprockets 67 and 69, with one reach 73 of such chain 71 having fixed thereto a weight 75 which is generally equal to the weight of the ring 25 and the elements mounted thereon. The ends 77 of the chain 71 are disposed outwardly of the mast 21 and, as shown in FIGS. 2–4, the carriage 23 is fastened thereto by bifurcated lugs 79 which are bolted at 81 to the carriage wall 53 and hinged by suitable pins to such chain ends 77.

With the presence of the counterweight 75, the carriage 23, and the ring 25 supported thereon, may be moved manually into a desired vertical position along the mast 21. Alternatively, motion may be transmitted to the chain 71 from the gear motor 59 by a drive chain. 83 which is laced over sprockets 85 and 87 fixed, respectively, to the shaft 63 and motor output shaft 89. As hereafter explained, means are incorporated into the embodiment of the machine here described for controlling the sequence and duration of operation of the motor 59.

The ring 25 is of rectangular configuration and, for ease of manufacture and shipment, is formed of two similar U-shaped units 91, the free ends of which are simply connected to each other during assembly. As seen in FIG. 3, each of the ring units 91 consists of channels 93 which are welded or otherwise connected into a U-shaped configuration. The channels 93 each include a web 95 and flanges 97 and, desirably, are reinforced by gusset plates 99 welded in place at spaced intervals along the lengths thereof.

Secured to the ring 25 are box beams 101 and 103 which add rigidity to the ring 25 and assist in its mounting onto the carriage 23. Referring to FIGS. 1-3, a pair of bearings 105 are fastened at 107 to the box beams 101 and 103 and embrace a guide rod 109 which extends horizontally through the carriage sleeve 45 and is locked in place by retainers 111. Cooperating with the bearings 105 and the guide rod 109 is a support arm 113 having a web 115, rigidifying flanges 117 and cap 119. As shown by broken lines in FIG. 5, one end of the support arm 113 is disposed between adjacent ends of the box beams 101 and 103 and is fastened thereto at 121. At the opposite end of the support arm 113, a roller 123 is mounted on and projects from the cap 119. This roller 123 is retained within and is adapted to ride along a guide 125, which simply consists of a channel having a web 127 and flanges 129 welded to the wall 47 of the carriage sleeve 45.

With the above described arrangement, the cooperating bearings 105 and guide rod 109 permit the ring 25 to be traversed relative to the carriage 23 and, under the weight of the ring 25 and the elements of the machine mounted thereon, the support arms 113 engages with the guide 125 to retain such ring 25 in substantially a horizontal plane. The horizontal stroke of the ring 25 is generally equal to the spacing between a bearing 105 and the wall 49.

In the event that the ring 25 meets with an obstruction, such as a misaligned object which is to be strapped, during its travel from an elevated retracted position to a projected position, the bearings 105 permit the ring 25 to swing upwardly about the guide rod 109. In this instance, the roller 123 on the support arm 113 depresses a contact bar 131, actuating a switch which, in turn and as more fully described hereafter, stops operation of the motor 59.

Figure 5:
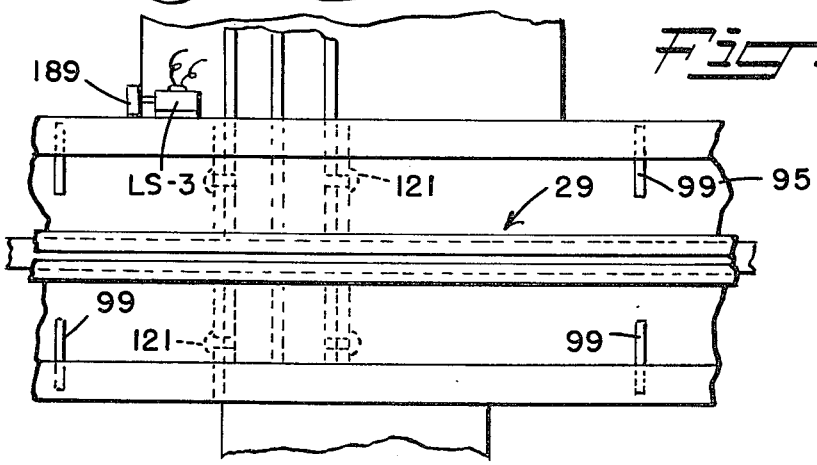
FIG. 5 is a fragmentary view of a portion of the machine shown in FIG. 2 as seen in the direction indicated by arrows V—V, with parts of the illustrated structure being broken away.

As shown in FIGS. 3 and 5, the contact bar 131 is floatingly supported within openings 133 formed in the side flanges 129 of the guide 125. One end of the contact bar 131 is positioned to engage with the adjacent switch, but is normally biased away from such engagement by spring 135 which is shown in FIG. 2. Cotter pins 137 or the like are passed through the opposite ends of the contact bar 131 to retain the same in place without inhibiting its floating movement.

Capable of traversing of the ring 25 through its horizontal stroke relative to the carriage 23 is a double acting pneumatic cylinder and piston assembly 139. The cylinder 141 of this assembly 139 is fastened at 143 to box beam 101, while the free end of the cooperating piston rod 145 has a collar 146 which is held captive, as shown in FIG. 4, by retainer 147 fixed to the carriage sleeve 45. Sufficient play is provided between the piston rod 145 and its retainer 147 to accommodate limited upward swinging movement of the ring 25.

In the embodiment of the machine here described, the sealing head 27 serves to deliver or advance strap from a supply and along the yoke 29, to provide a loop of strap about an object which is to be strapped, tension such strap onto the object, cut the tensioned strap loop from its supply and heat seal overlapping end portions thereof. As heretofore mentioned, in this described embodiment, the mechanisms for achieving these functions are essentially the same in both construction and operation as is described in detail in the Goodley patent 3,759,169.

As shown in FIG. 2, the sealing head 27 is mounted on the ring 25, substantially centrally of one side thereof, together with a strap accumulator, indicated by the reference character 149. A continuous strap from a supply reel, not shown, in guided into the accumulator 149 by a roller 151 and passes between a pair of rollers 153 as it is advanced into the sealing head 27. It will be noted that the axes of the rollers 153 lie in a plane which extends at right angles to a similar plane passing through the axis of the roller 151 so that, within the accumulator 149, the strap twists about its longitudinal axis through a 90° arc and is advanced on edge into the sealing head 27.

In the area of the sealing head 27, the web 95 of the ring channel 93 is provided with a suitable opening, not shown, to facilitate passage of strap into the yoke 29 and, also, to enable the sealing head 27 to perform the other of its functions on the strap. Desirably, the ring 25 is reinforced in the area of the sealing head 27, as by plates 155 welded to the flanges 97 of the ring channels 93.

As heretofore mentioned, in the embodiment here described, the yoke 29 is essentially of a construction as described in the Goodley U.S. Pat. No. 3,759,169. A portion of such yoke 29 is diagrammatically illustrated in FIGS. 3 and 5 and includes a rigid support member 157 which is fixed to the inner surface of the web 95 of the ring channel 93 and retractable strap retaining channels 159 which are resiliently urged together by captive compression springs, not shown. The strap is guided between the free end of the support member 157 and the inturned flanges of the channels 159 during lacing of the yoke 29 and, during tensioning, the strap simply pulls the spring-loaded channels 159 apart and slips from between such channels without damage.

As is apparent from the description given thus far, the machine requires both a supply of compressed air and electricity for operation. Compressed air is delivered from a supply by a conventional hose, not shown, which is adapted to be coupled onto a nipple at the end of a rigid conduit 163. A conventional air filter, regulator and lubricator assembly is indicated generally at 164. This assembly 164 is supported from the base 31 by an upright 165 and its conduit 163 extends along and is fixed to the mast 21 and up through the carriage sleeve 45 to a manifold 167 which is fixed to the mast 21. A hose 169 delivers the compressed air to a manifold 171 which, in turn, distributes the same to the sealing head 27 and the pneumatic cylinder and piston assembly 139.

Electricity is delivered to a distributor box 172 from a console, not shown, and is transmitted through a rigid conduit 173 to a junction box 175. The conduit 173 passes up through the carrier sleeve 45 and is fixed to the mast 21, as is the junction box 175. A flexible cable 176 delivers electricity to a distributor box 177 which, in turn, supplies electrical energy to the sealing head 27 and other electrical components which are supported on the ring 25 as hereafter described. Elec- tricity is also supplied from the distributor box 172 to the gear motor 59 and, for automatic operation, to various switches mounted on the mast, as hereafter described, and also to photoelectric cells 178 and 179 which sense the object 17 which is to be strapped. The cell 178 is carried on an arm 181 which extends from the mast 21 with its target 183 projecting from the conveyor 11. The cell 179 is carried by the ring 25 as is its target 185.

Both of the cells 178 and 179 assist in controlling the operation of the motor 59, as hereafter described. With the ring 25 elevated into its retracted position, the photo beam of the cell 178 is broken and then re-established as an object 17 is moved, from right to left as viewed in FIG. 1, along the conveyor 11 and into position within the machine for strapping. On the other hand, the photo beam of the cell 179 is broken as such unit moves past the upper surface of the object 17 during downward travel of the carriage 23 and is not re-established until carriage 23 resumes upward movement along the mast 21.

Before describing the sequence of an operational cycle, the more significant control elements for automatic operation of the illustrated embodiment of the machine are first briefly described. As will be apparent, the pneumatic and electrical controls of the sealing head 27, while mentioned here in some detail, are essentially the same as disclosed in the Goodley U.S. Pat. No. 3,759,169. To better appreciate the functions of the various control elements, it will be understood that the machine is in condition for performing an operational cycle when the carriage 23 and ring 25 are in their home or retracted positions; that is, with the carriage 23 in its uppermost elevated position on the mast 21 and the ring 25 in its rightmost position as seen in FIG. 2.

PHOTOELECTRIC SWITCHES - PC

Photoelectric switch PC-1 is part of cell 178 and, when its beam is broken and remade, causes the motor 59 to move the carriage 23 downwardly along the mast 21. Photoelectric switch PC-2 is part of cell 179 and the breaking and remaking of its beam stops the motor 59 and the carriage 23 during its upward movement along the mast 21. A time delay TDR-2 has its normally open contacts connected in series with the outputs of photoelectric switches PC-1 and PC-2, and thus prevents spurious photocell activation when they are initially energized.

LIMIT SWITCHES - LS

Limit switches LS-1, LS-1A and LS-3 control traversing movement of the ring 25. Either limit switch LS-1 or LS-1A will control air supply to the pneumatic cylinder and piston assembly 139 as the ring 25 is projected against the object 17 from its home position, while the limit switch LS-3 stops traversing of the ring 25 in the retracted or home position.

Limit switches LS-2, LS-4, and LS-5 control the operation of the motor 59, with the limit switches LS-2 and LS-4 being actuated by the carriage 23 in its lowermost project position and its retracted or home position, respectively. The limit switch LS-5 lies in the path of the contact bar 131 and is engergized upon upward tilting of the ring 25, as when it encounters an obstruction during its downward travel.

PRESSURE ELECTRIC SWITCHES - PE

These switches control operation of the sealing head 27, with a switch PE-2 being actuated when the strap is fully tensioned about the object 17 and initiating strap sealing. Switch PE-3 is energized when the sealing head 27 completes its strap sealing function and effects the retraction of the ring 25 into its home position.

TIME DELAY RELAYS - TDR

Time delay relay TDR-1 is energized by the pressure electric switch PE-2, together with an electric counter and, after a set period following the initiation of strap sealing, they together serve to eject the sealed strap against the object.

The operation of photoelectric switches PC-1 and PC-2 is controlled by the relay TDR-2 as discussed above.

When the machine is set for automatic operation, time delay relay TDR-3 is energized and if, for any reason, strap is not applied to the object before this relay times out, the ring 25 will be retracted to its home position and then moved to its lowermost projected position, if not already there, for the attention of the operator.

Time delay relay TDR-4 is actuated when the photo beam of the switch PC-2 is remade during upward travel of the ring 25 and determines the distance below the top surface of the object 17 at which such ring 25 is stopped for applying a second strap.

Figure 6:
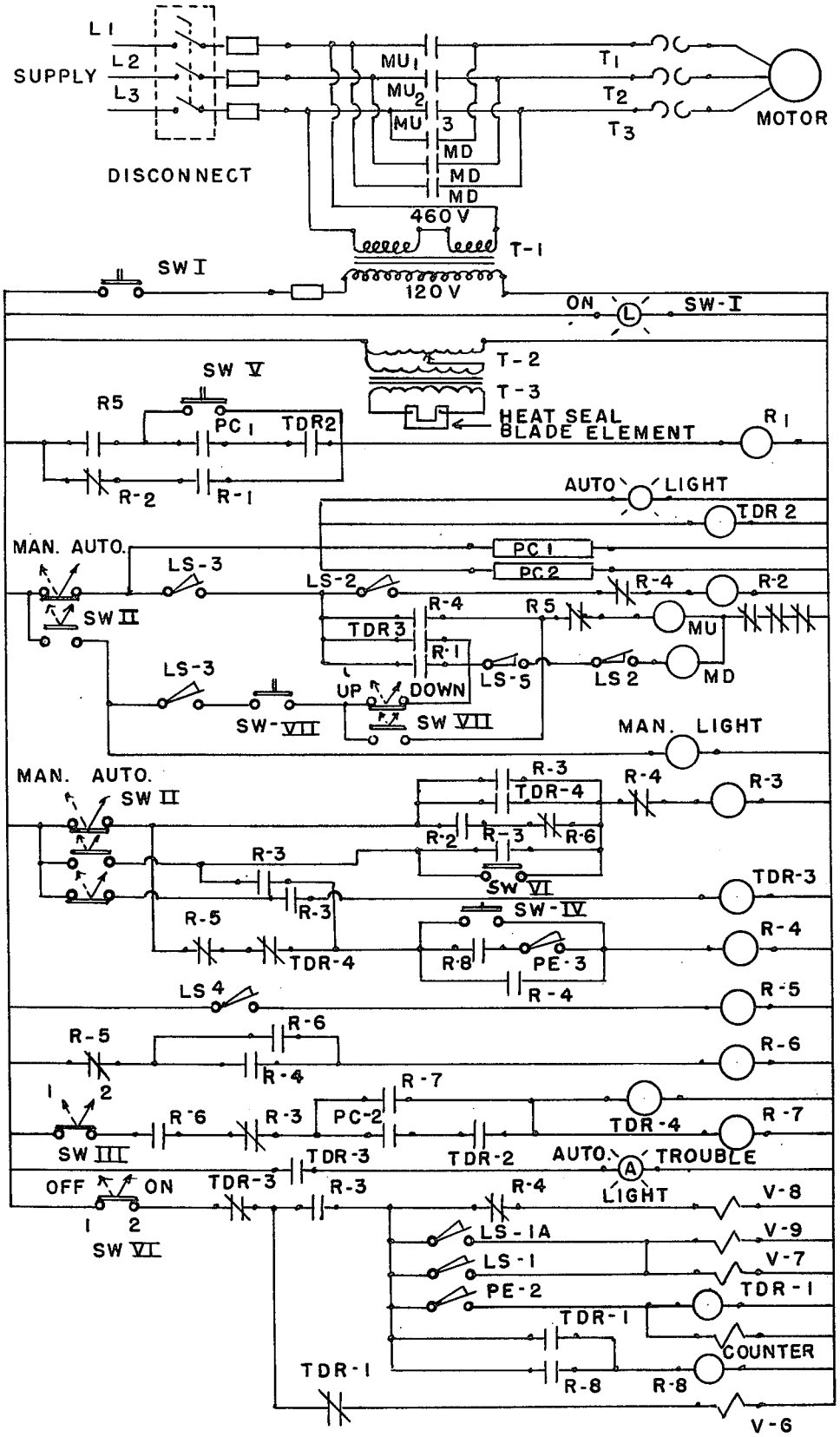
FIGS. 6 and 7 are diagrams of the electrical and pneumatic systems, respectively, incorporated in the apparatus of the present invention.
Figure 7:
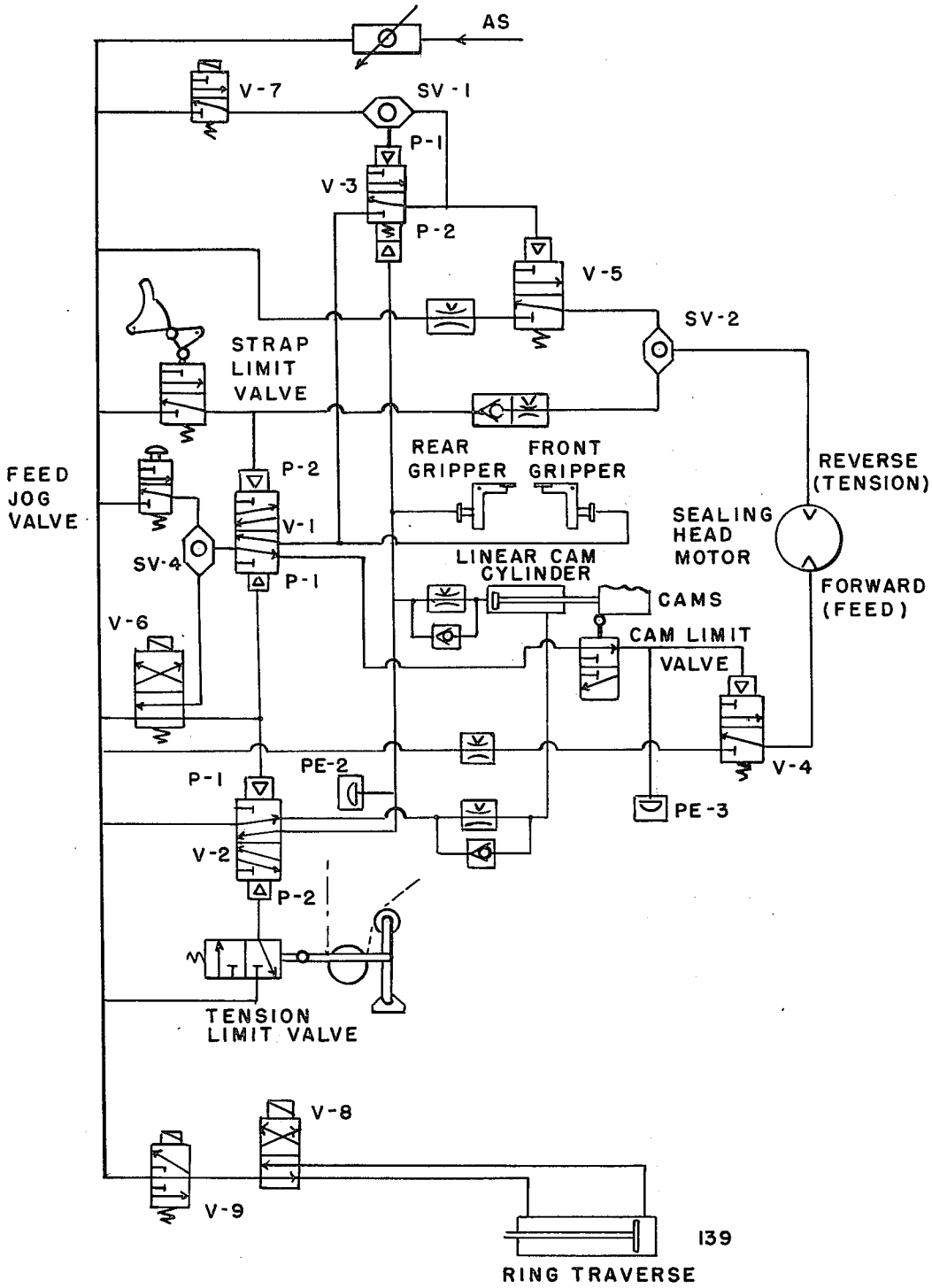

With reference to FIGS. 6 and 7, the machine is prepared for automatic operation by turning on switch SW-I, supplying power to transformers T-2 and T-3, with the latter energizing the heater for the blade of the sealing head 27. Switch VI is also turned on, energizing the solenoid valve V-6 and causing strap to be fed around the yoke 29.. At this stage, switch SW-II is placed in its "AUTO" mode, to activate photoelectric switches PC-1 and PC-2 through the time delay relay TDR-2.

The automatic cycle is initiated by push botton switch SW-V or by breaking and remaking of the photo beam of the photoelectric switch PC-1, either of which will energize relay R-1 which, in turn, will actuate motor starter relay MD (motor down) and cause the carriage 23 to travel downwardly along the mast 21. If the ring 25 encounters an obstruction, limit switch LS-5 will stop operation of the motor 59. Otherwise, the ring 25 will descend until the limit switch LS-2 is actuated to stop the motor 59 and arrest the carriage 23 and the ring 25 in a position for applying a strap 187 about the object at a desired location adjacent to its lowermost end. More specifically, the actuation of the limit switch LS-2 energizes relays R-2 and R-3 and the valve V-8 and resets the relay R-1. As illustrated in FIG. 1, the limit switches LS-2 and LS-4 are mounted on the mast 21. Preferably both of these limit switches, and particularly the switch LS-2, are adjustable vertically relative to the mast 21 so that the positions at which the carriage 23 and ring 25 are arrested may be varied relative to the lowermost end of the object 17.

With the operation on valve V-8, air is delivered to the cylinder and piston assembly 139 to project the ring 25 from its home position and against the object 17. When either limit switch LS-1 or LS-1A is actuated, valve V-7 is energized, to effect strap tensioning about the object 17, together with valve V-9 which stops air delivery to the valve V-8 and the assembly 139. Once the strap is tensioned, it is then sealed and pressure electric switch PE-2 is actuated, energizing time delay relay TDR-1 and an electric cycle counter. Once the time delay relay TDR-1 times out, relay R-8 is energized and the sealing head 27 signals the completion of its operation by closing the pressure electric switch PE-3.

The closure of the relay R-8 and the pressure electric switch PE-3 energizes relay R-4; sets relay R-6, to prevent further straps application at this projected position of the ring 25, and resets the relay R-3. This latter relay R-3 de-energizes the valves V-8 and V-9, causing the ring 25 to be retracted into its home position against the limit switch LS-3, and resets the time delay relay TDR-1 and the relay R-8. The limit switch LS-3, as illustrated in FIG. 5, is carried by the ring 25 and is actuated by contacting with an arm 189 fixed to projecting from the carriage 23.

The motor starter relay MU (motor up) is now operative to elevate the ring 25 from its lowermost position. If 1 strap is selected at switch SW-III, the carriage 23 and ring 25 will be retracted, after applying the tensioned strap loop 187, to the home position where the carriage 23 contacts the limit switch LS-4, energizes the relay R-5 which resets the relays R-6 and R-4, and which in turn, de-energizes the motor relay MU. The machine is now ready for another operational cycle.

Alternatively, if 2 straps are selected at switch SW-III, the ring 25 will be moved upwardly until the beam of the photoelectric switch PC-2 is remade, thus energizing the time delay relay TDR-4 and relay R-7. When timed out, the relay TDR-4, de-energizes relay R-4, to stop the motor 59 and arrest the carriage 23 and ring 25 in position as shown in FIG. 2 for applying a strap 191 at a desired location relative to the uppermost end of the object 17. Further, when the time delay relay TDR-4 time out, R-3 is energized to reset the relay R-7 and the time delay relay TDR-4 and initiate another strapping cycle. Once a strap 191 is applied to the object 17, the relay R-4 will be energized and the motor 59 will elevate the carriage into its retracted or home position. Here the carriage 23 actuates the limit switch LS-4, energizing the relay R-5 which resets the relays R-6 and R-4 and which, in turn, de-energizes the motor relay MU. The machine is now ready for another operational cycle.

As noted above, relay R-3 actuates the valve V-8 to cause the ring 25 to traverse into the object 17. This relay R-3 also energizes the time delay relay TDR-3 and, if a strap is not applied to the object 17 before the relay TDR-3 times out, valves V-8 and V-6 are de-energized causing the ring 25 to retract to its home position. Once the ring 25 is retracted, the limit switch LS-3 is actuated and deactivates the sealing head 27 at whatever function it may be then performing. If the carriage 23 is not at this time in its lowermost position, the motor relay MD is operative to lower the carriage 23 until the limit switch is activated. A trouble light calls the operator's attention to the machine malfunction. Now the switch SW-II is placed in its "MANUAL" mode and returned to its "AUTO" mode once the necessary correction has been made. Switch IV is then depressed to resume automatic operation.

For manual operation of the machine, the switch SW-II is set in its "MANUAL" mode and the ring 25 may be moved by hand or with the switch SW-VII. In the manual operation, no automatic functions may be energized without operator initiation.

It is to be understood that changes and variations may be made without departing from the spirit and scope of the invention as defined in the appended claims.

What is claimed is:

1. A machine for applying a tensioned strap loop horizontally about the girth of an object including a mast, a ring extending laterally from said mast in substantially a horizontal plane and supported on said mast for movement longitudinally thereof between a retracted position and a projected position in which said ring encircles an object which is to be strapped, a sealing head mounted on said ring, means supporting said ring for traversing in its horizontal plane relative to said mast between a retracted position and a projected position in which said sealing head is located immediately adjacent to an object which is to be strapped, and a strap yoke mounted on said ring in the horizontal plane thereof and opening along the interior thereof, said yoke communicating with said sealing head and together there- with providing a generally continuous passage for lacing of strap along said ring as a loop having its leading end overlying with a trailing portion thereof at said sealing head, said sealing head including means for tensioning a strap laced within said ring to provide a tensioned strap loop about an object which is to be strapped and means for securing together overlapping portions of the tensioned strap loop.

2. A machine as defined in claim 1 wherein said ring is supported on said mast by means of a carriage, said carriage being mounted on said mast for movement longitudinally thereof and means mounting said ring on said carriage for movement therewith and for traversing in its horizontal plane relative to said carriage.

3. A machine as defined in claim 2 further including a drive for moving said carriage longitudinally of said mast, said drive including a weight, means on said mast connecting said weight with said carriage for movement concomitantly with but in directions opposite to that of said carriage as it is moved longitudinally of said mast, said weight essentially counterbalancing the weight of said carriage and the elements of the machine supported thereon.

4. A machine as defined in claim 2 further including a drive for moving said carriage longitudinally of said mast and a drive for traversing said ring relative to said carriage.

5. A machine as defined in claim 4 wherein said drive for moving said carriage includes a motor, and further including control means for actuating said motor and for arresting said motor as said carriage enters into its retracted and projected positions.

6. A machine as defined in claim 5 wherein said means mounting said ring to said carriage includes means permitting limited upward swinging movement of said ring about a horizontal axis located at said carriage and wherein said control means further includes means for arresting said motor during upward swing movement of said ring.

7. A machine as defined in claim 5 wherein said control means for actuating said motor includes means for sensing an object to be strapped within the machine.

8. A machine as defined in claim 5 wherein said control means for arresting said motor as said carriage enters into a projected position includes means for sensing the uppermost surface of an object which is to be strapped.

9. A machine as defined in claim 4 wherein said drive for traversing said ring includes control means for arresting said ring traversing drive as said carriage enters into its retracted and projected positions.

10. A machine as defined in claim 9 wherein said drive for moving said carriage includes a motor, and further including control means for actuating said motor and for arresting said motor as said carriage enters into its retracted and projected positions.

11. A machine as defined in claim 10 wherein said control means for said ring traverse drive further includes means for operating such drive to traverse said ring into a projected position only when said carriage is in a projected position and said control means for said motor includes means for operating said motor only when said ring is in a retracted position.

12. A machine as defined in claim 11 wherein said control means for actuating said motor includes means for sensing an object to be strapped within the machine.

13. A machine as defined in claim 11 wherein said control means for arresting said motor as said carriage enters into a projected position includes means for sensing the uppermost surface of an object which is to be strapped.

14. A machine as defined in claim 10 wherein said control means for actuating said motor includes means for sensing an object to be strapped within the machine.

15. A machine as defined in claim 10 wherein said control means for arresting said motor as said carriage enters into a projected position includes means for sensing the uppermost surface of an object which is to be strapped.

16. A machine as defined in claim 10 further including time delay means operatively connected with said sealing head and said control means for said ring and said carriage drives, said time delay means serving to operate sequentially the control means for said ring drive to effect ring retraction and the control means for said carriage drive to effect carriage projection into its lowermost position on said mast in the event of malfunction in any of the ring drive, ring drive control means and the sealing head.

* * * * *

UNITED STATES PATENT OFFICE

CERTIFICATE OF CORRECTION

PATENT NO. : 4,005,647

DATED : February 1, 1977

INVENTOR(S) : George F. Goodley, William H. Woomer, Udaykumar B. Inamdar and Robert L. Gallagher It is certified that error appears in the above-identified patent and that said Letters Patent are hereby corrected as shown below:

Column 2, line 10, "conven- tional" should read --conventional--; line 18, "State" should read --States--, "by" should read --to--; line 19, "incor- porated" should read --incorporated--; line 24, "head," should read --head;--; line 27, "strapped" should read --strapped after the strap--, "portions" should read --portion--. Column 3, line 50, "In" should start the new paragraph; line 51, "ings" should read --ings,--. Column 4, line 63, "fixed." should read --fixed,--. Column 6, line 67, "Elec- tricity" should read --Electricity--. Column 7, line 57, "LS-4," should read --LS-4--; line 60, "project" should read --projected--. Column 8, line 33, "29.." should read --29.--. Column 9, line 6, "straps" should read --strap--; line 17, "1" should read --"1"--; line 24, "2" should read --"2"--; line 33, "time" should read --times--. Column 10, line 17, "there- with" should read --therewith--.

Signed and Sealed this

*Third* Day of *January 1978*

[SEAL]

*Attest:*

RUTH C. MASON
*Attesting Officer*

LUTRELLE F. PARKER
*Acting Commissioner of Patents and Trademarks*